US007456575B2

(12) United States Patent
Miyata et al.

(10) Patent No.: US 7,456,575 B2
(45) Date of Patent: Nov. 25, 2008

(54) PLASMA DISPLAY PANEL AND METHOD OF MANUFACTURING SAME

(75) Inventors: Takashi Miyata, Yamanashi (JP); Masaru Nishimura, Yamanashi (JP); Shunsuke Itakura, Yamanashi (JP)

(73) Assignee: Pioneer Corporation, Tokyo (JP)

( * ) Notice: Subject to any disclaimer, the term of this patent is extended or adjusted under 35 U.S.C. 154(b) by 0 days.

(21) Appl. No.: 11/384,346

(22) Filed: Mar. 21, 2006

(65) Prior Publication Data

US 2006/0214585 A1 Sep. 28, 2006

(30) Foreign Application Priority Data

Mar. 22, 2005 (JP) ..... 2005-081909

(51) Int. Cl.
*H01J 17/49* (2006.01)

(52) U.S. Cl. ..... 313/587; 313/584; 313/585; 313/586

(58) Field of Classification Search ..... 313/582–587
See application file for complete search history.

(56) References Cited

U.S. PATENT DOCUMENTS

| | | | | |
|---|---|---|---|---|
| 5,039,509 | A * | 8/1991 | Miyata et al. | 423/636 |
| 6,013,309 | A | 1/2000 | Kim et al. | |
| 6,379,783 | B1 | 4/2002 | Kim et al. | |
| 6,674,238 | B2 | 1/2004 | Otani et al. | |
| 6,788,373 | B2 | 9/2004 | Ito et al. | |
| 2002/0036466 | A1 * | 3/2002 | Tanaka et al. | 313/586 |
| 2004/0056594 | A1 * | 3/2004 | Kotera et al. | 313/582 |
| 2004/0075388 | A1 * | 4/2004 | Miyashita et al. | 313/586 |
| 2005/0082982 | A1 * | 4/2005 | Kim | 313/587 |
| 2005/0088095 | A1 * | 4/2005 | Kim | 313/586 |
| 2005/0134178 | A1 * | 6/2005 | Kim | 313/587 |
| 2005/0206318 | A1 * | 9/2005 | Hirota et al. | 313/585 |

FOREIGN PATENT DOCUMENTS

| | | |
|---|---|---|
| EP | 1 580 786 | 9/2005 |
| EP | 1 600 921 | 11/2005 |
| EP | 1 638 127 | 3/2006 |
| EP | 1 657 735 | 5/2006 |
| JP | 6-325696 | 11/1994 |

(Continued)

OTHER PUBLICATIONS

Nishida, A., et al., "Preparation and Properties of Magnesia Powder by Vapor Phase Oxidation Process", Journal of The Society of Materials Science, vol. 36, No. 410, pp. 1157-1161, Nov. 1987.

(Continued)

*Primary Examiner*—Karabu Guharay
*Assistant Examiner*—Bumsuk Won
(74) *Attorney, Agent, or Firm*—McGinn IP Law Group, PLLC

(57) ABSTRACT

The discharge space defined between the front glass substrate and the back glass substrate is filled with a discharge gas including 10 or more vol % of xenon. A MgO layer including MgO crystals causing a cathode-luminescence emission having a peak within a wavelength range of 200 nm to 300 nm upon excitation by an electron beam is provided in a position facing the discharge cell formed in the discharge space.

11 Claims, 9 Drawing Sheets

SECTION V-V

FOREIGN PATENT DOCUMENTS

| | | |
|---|---|---|
| JP | 7-37510 | 2/1995 |
| JP | 07-192630 | 7/1995 |
| JP | 7-296718 | 11/1995 |
| JP | 08-287823 | 11/1996 |
| JP | 9-167566 | 6/1997 |
| JP | 10-233157 | 9/1998 |
| JP | 2000-156153 | 6/2000 |
| JP | 2001-076629 | 3/2001 |
| JP | 2002-33053 | 1/2002 |
| JP | 2003-31130 | 1/2003 |

OTHER PUBLICATIONS

International Search Report dated Jan. 18, 2005.
European Search Report dated Sep. 21, 2007.

* cited by examiner

EMBODIMENT

SECTION V-V

SECTION W-W

SINGLE CRYSTALLINE MgO OF CUBIC SINGLE-CRYSTAL STRUCTURE

SINGLE CRYSTALLINE MgO OF CUBIC POLYCRYSTAL STRUCTURE

FIG. 8

COMPARISON OF BREAKDOWN VOLTAGE

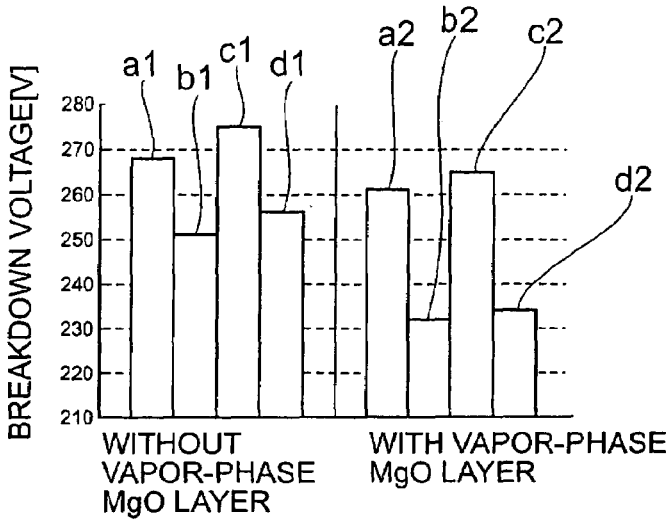

a1,a2:BREAKDOWN VOLTAGE BETWEEN ROW ELECTRODES b1,b2:BREAKDOWN VOLTAGE BETWEEN ROW ELECTRODE AND COLUMN ELECTRODE(RED PHOSPHOR LAYER)

c1,c2:BREAKDOWN VOLTAGE BETWEEN ROW ELECTRODE AND COLUMN ELECTRODE(GREEN PHOSPHOR LAYER)

d1,d2:BREAKDOWN VOLTAGE BETWEEN ROW ELECTRODE AND COLUMN ELECTRODE(BLUE PHOSPHOR LAYER)

FIG. 9

COMPARISON OF DISCHARGE VARIATION

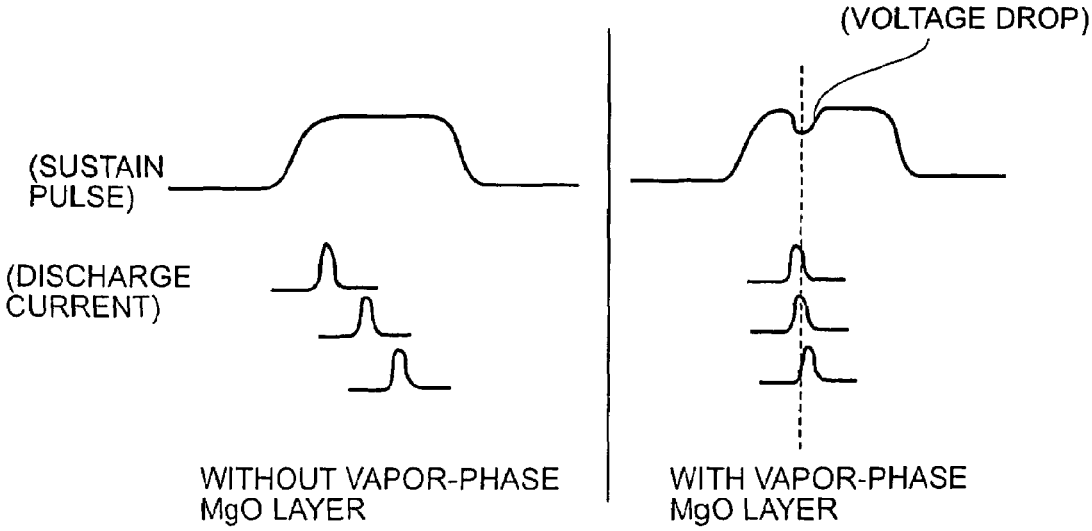

PLASMA DISPLAY PANEL AND METHOD OF MANUFACTURING SAME

BACKGROUND OF THE INVENTION

1. Field of the Invention

This invention relates to a structure of plasma display panels and a method of manufacturing the plasma display panels.

The present application claims priority from Japanese Application No. 2005-081909, the disclosure of which is incorporated herein by reference.

2. Description of the Related Art

A surface-discharge-type alternating-current plasma display panel (hereinafter referred to as "PDP") includes two opposing glass substrates placed on either side of a discharge space. On one of the two glass substrates a plurality of row electrode pairs, which extend in the row direction, are regularly arranged in the column direction and covered by a dielectric layer. On the dielectric layer, a magnesium oxide film having the function of protecting the dielectric layer and the function of emitting secondary electrons into the unit light emission area is formed by a vapor deposition technique. On the other glass substrate, a plurality of column electrodes extending in the column direction are regularly arranged in the row direction, thus forming the unit light emission areas (discharge cells) in matrix form in positions corresponding to the intersections between the row electrode pairs and the column electrodes in the discharge space.

Phosphor layers, to which the primary colors, red, green and blue are applied, are formed in the respective discharge cells.

The discharge space of the PDP is filled with a discharge gas consisting of a gas mixture of neon and xenon.

The PDP initiates a reset discharge simultaneously between paired row electrodes, and then an address discharge selectively between one of the paired row electrodes and the column electrode. The address discharge results in the distribution, over the panel surface, of light-emitting cells having the deposition of the wall charge on the dielectric layer adjoining each discharge cell and no-light-emitting cells in which the wall charge has been erased from the dielectric layer. Then, a sustaining discharge is produced between the paired row electrodes in the light-emitting cells. The sustaining discharge results in the emission of vacuum ultraviolet light from the xenon included in the discharge gas filling the discharge space. The vacuum ultraviolet light excites the phosphor layer, whereupon the red, green and blue phosphor layers emit visible light to generate an image on the panel surface.

Conventionally, in PDPs structured as described above, it is difficult to improve the luminous efficiency of the panel while preventing an increase in the breakdown voltage and a decrease in the discharge probability in each of there set, address and sustaining discharges, and the compatibility between them has been an issue over the years.

SUMMARY OF THE INVENTION

An object of the present invention is to solve the problem associated with conventional PDPs as described above.

To attain this object, the present invention provides a plasma display panel which is equipped with opposing front and back substrates placed on either side of a discharge space, a plurality of row electrode pairs provided between the front and back substrates, and a plurality of column electrodes provided between the front and back substrates and extending in a direction at right angles to the row electrode pairs to form unit light emission areas in the discharge space at positions respectively corresponding to the intersections with the row electrode pairs. In the plasma display panel, the discharge space is filled with a discharge gas including 10 or more vol % of xenon, and a magnesium oxide layer including magnesium oxide crystals causing a cathode-luminescence emission having a peak within a wavelength range of 200 nm to 300 nm upon excitation by an electron beam is provided in a position facing the unit light emission areas.

In an exemplary embodiment of the plasma display panel (PDP) according to the present invention, row electrode pairs extending in the row direction and column electrodes extending in the column direction to form discharge cells in the discharge space in positions corresponding to intersections with the row electrode pairs are provided between a front glass substrate and a back glass substrate. Further, a magnesium oxide layers, which includes magnesium oxide crystals produced by use of vapor-phase oxidization and causing a cathode-luminescence emission having a peak within a wavelength range of 200 nm to 300 nm upon excitation by an electron beam, is provided on portion of the face of a dielectric layer facing at least the discharge cells, the dielectric layer covering either the row electrode pairs or the column electrodes. The discharge space defined between the front glass substrate and the back glass substrate is filled with a discharge gas including 10 or more vol % of xenon.

In the PDP in the exemplary embodiment, the luminous efficiency is enhanced, because the discharge gas filling the discharge space includes 10 or more vol % of xenon. Further, the magnesium oxide layer, which includes the vapor-phase magnesium oxide crystals causing a cathode-luminescence emission having a peak within a wavelength range of 200 nm to 300 nm upon excitation by an electron beam, is formed on the portion facing the discharge cells, whereby a rise in the breakdown voltage with an increase in the partial pressure of the xenon in the discharge gas is inhibited and the discharge delay time is shortened, so that a range of discharge variation is narrowed, resulting in a further improvement in the luminous efficiency.

These and other objects and features of the present invention will become more apparent from the following detailed description with reference to the accompanying drawings.

BRIEF DESCRIPTION OF THE DRAWINGS

FIG. 8 is a comparison graph showing the reduction effect of the breakdown voltage in the PDP of the embodiment.

FIG. 9 is a comparison diagram showing the improvement of the discharge variation in the PDP of the embodiment;

DETAILED DESCRIPTION OF THE PREFERRED EMBODIMENT

Figure 1:
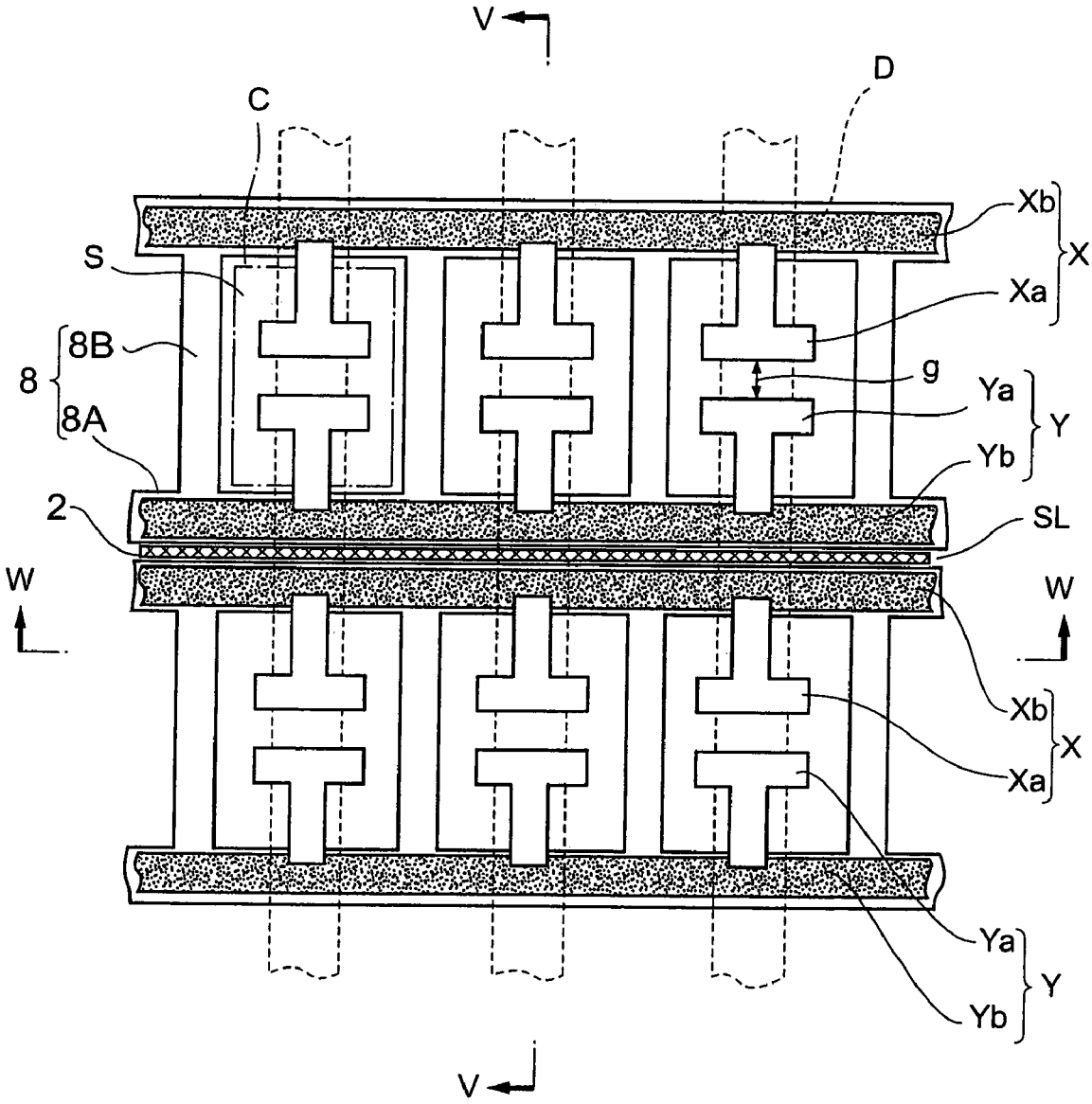
FIG. 1 is a front view illustrating an embodiment of the present invention.
Figure 2:
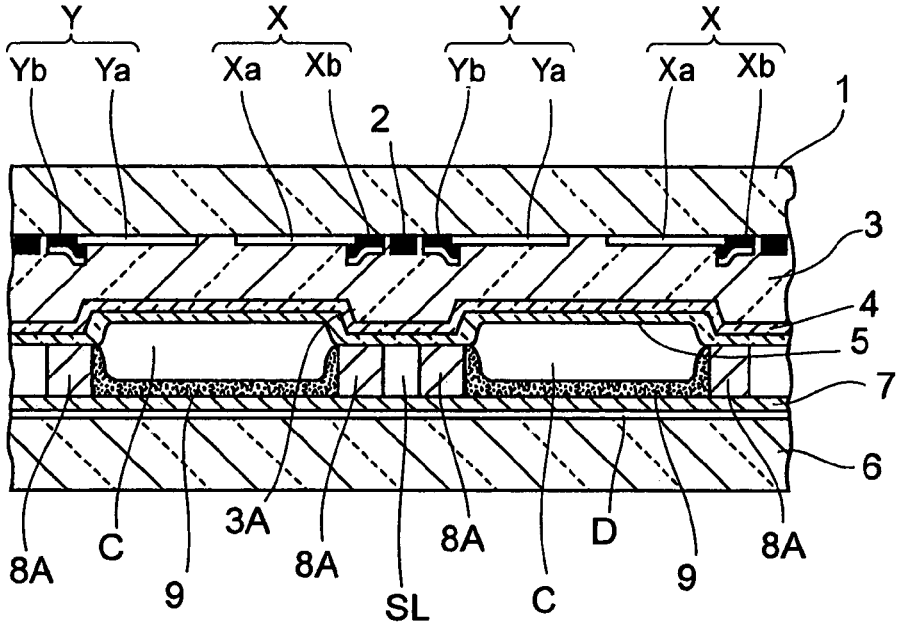
FIG. 2 is a sectional view taken along the V-V line in FIG. 1.
Figure 3:
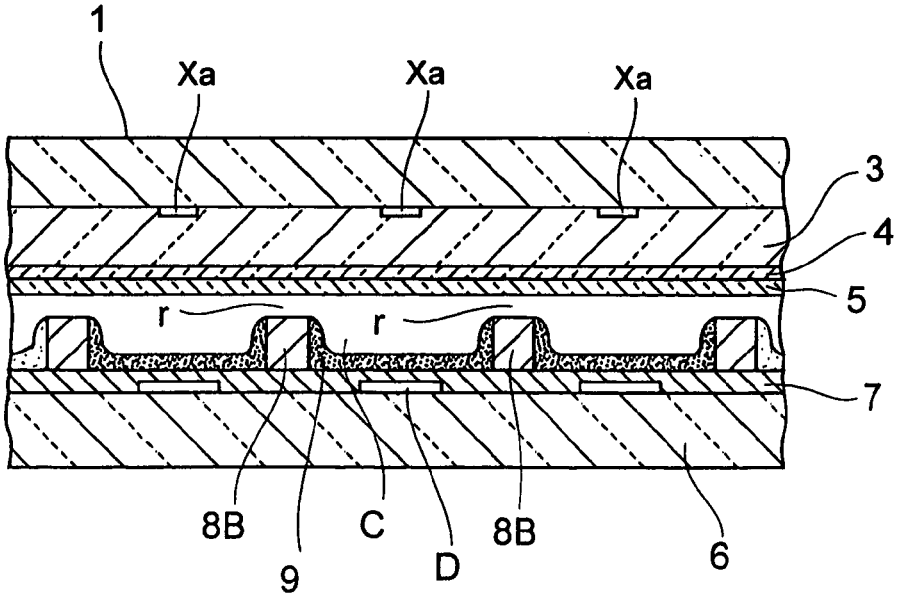
FIG. 3 is a sectional view taken along the W-W line in FIG. 1.

FIGS. 1 to 3 illustrate an embodiment of the PDP according to the present invention. FIG. 1 is a schematic front view of the PDP in the embodiment. FIG. 2 is a sectional view taken along the V-V line in FIG. 1. FIG. 3 is a sectional view taken along the W-W line in FIG. 1.

The PDP in FIGS. 1 to 3 includes a front glass substrate 1 serving as the display surface and a plurality of row electrode pairs (X, Y) extending in the row direction of the front glass substrate 1 (the right-left direction in FIG. 1) and arranged in parallel on the rear-facing face (the face facing toward the rear of the PDP) of the front glass substrate 1.

The row electrode X is composed of T-shaped transparent electrodes Xa formed of a transparent conductive film made of ITO or the like, and a bus electrode Xb formed of a metal film. The bus electrode Xb extends in the row direction of the front glass substrate 1, and is connected to the narrow proximal ends (corresponding to the foot of the "T") of the transparent electrodes Xa.

Likewise, the row electrode Y is composed of T-shaped transparent electrodes Ya formed of a transparent conductive film made of ITO or the like, and a bus electrode Yb formed of a metal film. The bus electrode Yb extends in the row direction of the front glass substrate 1, and is connected to the narrow proximal ends of the transparent electrodes Ya.

The row electrodes X and Y are arranged in alternate positions in the column direction of the front glass substrate 1 (the vertical direction in FIG. 1). In each row electrode pair (X, Y), each of the transparent electrodes Xa and Ya, which are regularly spaced along the associated bus electrodes Xb and Yb, extends out toward its counterpart in the row electrode pair, so that the wide distal ends (corresponding to the head of the "T") of the transparent electrodes Xa and Ya face each other with a discharge gap g having a required width in between.

Black- or dark-colored light absorption layers (light-shield layers) 2 are further formed on the rear-facing face of the front glass substrate 1. Each of the light absorption layers 2 extends in the row direction along and between the opposing sides of the bus electrodes Xb and Yb of the respective row electrode pairs (X, Y) which are adjacent to each other in the column direction.

A dielectric layer 3 is formed on the rear-facing face of the front glass substrate 1 to cover the row electrode pairs (X, Y). Additional dielectric layers 3A are formed on the rear-facing face of the dielectric layer 3 to project therefrom toward the rear of the PDP. Each of the additional dielectric layers 3A is placed opposite the adjacent two bus electrodes Xb and Yb of the respective row electrode pairs (X, Y) and the area between them, and extends parallel to these bus electrodes Xb and Yb.

On the rear-facing faces of the dielectric layer 3 and the additional dielectric layers 3A, a magnesium oxide layer 4 of thin film (hereinafter referred to as "thin-film MgO layer 4") is formed by vapor deposition or spattering so as to cover the entire rear-facing faces of the layers 3 and 3A.

A magnesium oxide layer 5 including magnesium oxide single crystals (hereinafter referred to as "crystalline MgO layers 5") is formed on the rear-facing face of the thin-film MgO layer 4. The magnesium oxide single crystals included in the crystalline MgO layer 5 cause a cathode-luminescence emission (CL emission) having a peak within a wavelength range of 200 nm to 300 nm (particularly, of 230 nm to 250 nm, around 235 nm) upon excitation by electron beams as described later.

The crystalline MgO layer 5 is formed on the entire rear-facing face of the thin-film MgO layer 4 or a portion of the rear-facing face of the layer 4, for example, facing each of the discharge cells which will be described later (in the example illustrated in FIGS. 1 to 3, the crystalline MgO layer 5 is formed on the entire rear-facing face of the thin-film MgO layer 4).

The crystalline MgO layer 5 is formed by spraying a powder of MgO crystals as described above on the thin-film MgO layer 4, for example.

The front glass substrate 1 is parallel to a back glass substrate 6. Column electrodes D each extend in a direction at right angles to the row electrode pairs (X, Y) (i.e. the column direction) along a strip opposite to the paired transparent electrodes Xa and Ya in each row electrode pair (X, Y), and are arranged in parallel at predetermined intervals on the front-facing face (the face facing toward the display surface) of the back glass substrate 6.

On the front-facing face of the back glass substrate 6, a white column-electrode protective layer (dielectric layer) 7 covers the column electrodes D, and in turn partition wall units 8 are formed on the column-electrode protective layer 7.

Each of the partition wall units 8 is formed in an approximate ladder shape made up of a pair of transverse walls 8A extending in the row direction in the respective positions opposite to the bus electrodes Xb and Yb of each row electrode pair (X, Y), and vertical walls 8B each extending in the column direction between the pair of transverse walls 8 in a mid-position between the adjacent column electrodes D. The partition wall units 8 are regularly arranged in the column direction in such a manner as to form an interstice SL extending in the row direction between the opposing two transverse walls 8A of the respective partition wall units 8 adjacent to each other.

The ladder-shaped partition wall units 8 partition the discharge space S defined between the front glass substrate 1 and the back glass substrate 6 into quadrangles to form discharge cells C in positions each corresponding to the paired transparent electrodes Xa and Ya in each row electrode pair (X, Y).

In each discharge cell C, a phosphor layer 9 covers five faces: the side faces of the transverse walls 8A and the vertical walls 8B of the partition wall unit 8 and the face of the column-electrode protective layer 7. The colors of the phosphor layers 9 are arranged such that the three primary colors, red, green and blue, in the respective discharge cells C are arranged in order in the row direction.

The crystalline MgO layer 5 (or the thin-film MgO layer 4 if the crystalline MgO layer 5 is formed only on a portion of the rear-facing face of the thin-film MgO layer 4 facing each discharge cell C) covering the additional dielectric layers 3A is in contact with the front-facing face of each of the transverse walls 8A of the partition wall units 8 (see FIG. 2), so that the additional dielectric layer 3A blocks off the discharge cell C and the interstice SL from each other. However, the front-facing face of the vertical wall 8B is out of contact with the crystalline MgO layer 5 (or the thin-film MgO layer 4) (see FIG. 3), to form a clearance r therebetween, so that the adjacent discharge cells C in the row direction interconnect with each other by means of the clearance r.

The discharge space S is filled with a discharge gas including 10 or more vol % of xenon giving a high xenon partial pressure.

For the buildup of the crystalline MgO layer 5, a spraying technique, electrostatic coating technique or the like is used to deposit the MgO crystals as described earlier on the rear-facing face of the thin-film MgO layer 4 covering the dielectric layer 3 and the additional dielectric layers 3A.

For the sake of reference, the embodiment illustrates the case where the thin-film MgO layer 4 is formed on the rear-facing faces of the dielectric layer 3 and additional dielectric layers 3A and then the crystal line MgO layer S is formed on the rear-facing face of the thin-film MgO layer 4. However, the crystalline MgO layer 5 can be alternatively formed on the rear-facing faces of the dielectric layer 3 and additional dielectric layers 3A and then the thin-film MgO layer 4 will be formed on the rear-facing face of the crystalline MgO layer 5.

Figure 4:
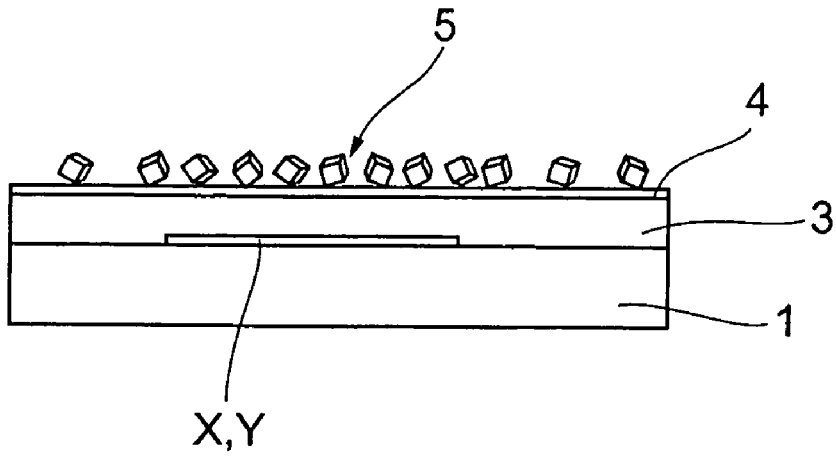
FIG. 4 is a sectional view showing the state of a crystalline magnesium layer formed on a thin film magnesium layer in the embodiment.

FIG. 4 shows the state when the thin-film MgO layer 4 is first formed on the rear-facing face of the dielectric layer 3 and then MgO crystals are affixed to the rear-facing face of the thin-film MgO layer 4 to form the crystalline MgO layer 5 by use of a spraying technique, electrostatic coating technique or the like.

Figure 5:
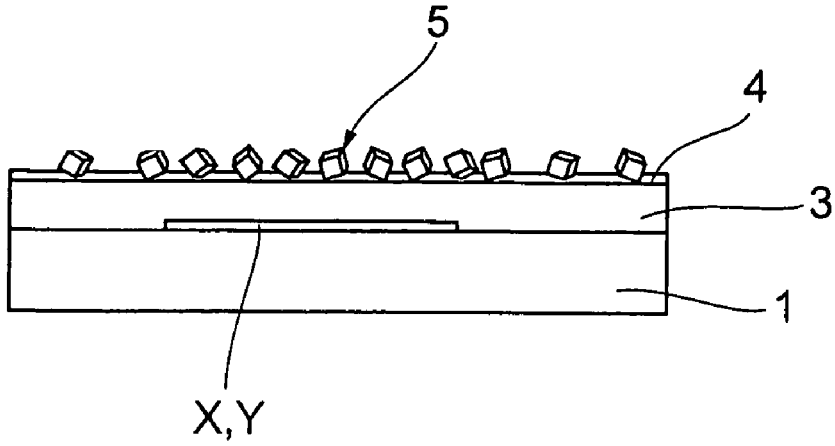
FIG. 5 is a sectional view showing the state of a thin film magnesium layer formed on a crystalline magnesium layer in the embodiment.

FIG. 5 shows the state when the MgO crystals are affixed to the rear-facing face of the dielectric layer 3 to form the crystalline MgO layer 5 by use of a spraying technique, electrostatic coating technique or the like, and then the thin-film MgO layer 4 is formed.

The crystalline MgO layer 5 of the PDP is formed by use of the following materials and method.

Figure 6:
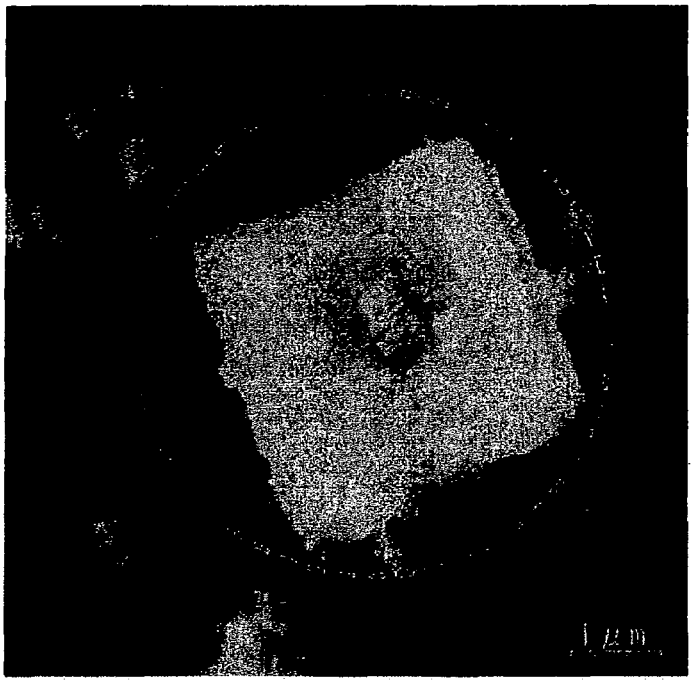
FIG. 6 is a SEM photograph of the magnesium oxide single crystal having a cubic single-crystal structure.
Figure 7:
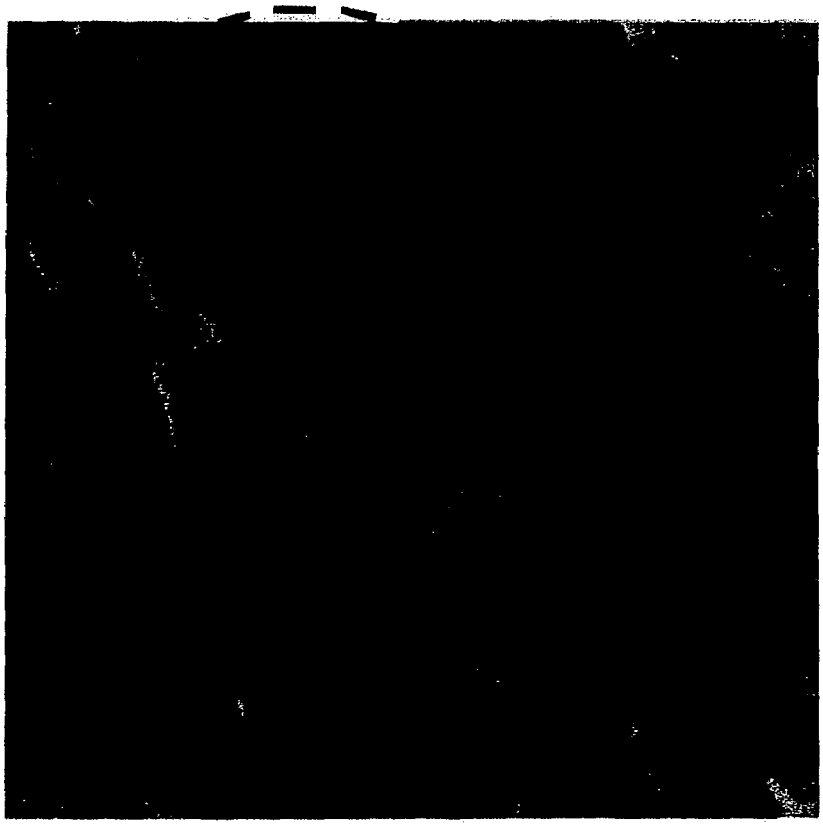
FIG. 7 is a SEM photograph of the magnesium oxide single crystal having a cubic polycrystal structure.

Examples of MgO crystals, used as materials for forming the crystalline MgO layer 5 and causing CL emission having a peak within a wavelength range of 200 nm to 300 nm (particularly, of 230 nm to 250 nm, around 235 nm) by being excited by an electron beam, include a single crystal of magnesium which is obtained by performing vapor-phase oxidization on magnesium steam generated by heating magnesium (this magnesium single crystal is hereinafter referred to as "vapor-phase MgO single crystal") Examples of the vapor-phase MgO single crystals include an MgO single crystal having a cubic single crystal structure as illustrated in the SEM photograph in FIG. 6, and an MgO single crystal having a structure of cubic crystals fitted to each other (i.e. a cubic polycrystal structure) as illustrated in the SEM photograph in FIG. 7.

The vapor-phase MgO single crystal contributes to an improvement in the discharge characteristics as described later.

As compared with MgO obtained by other methods, the vapor-phase magnesium oxide single crystal has the features of being of a high purity, taking a microscopic particle form, causing less particle agglomeration, and the like.

The vapor-phase MgO single crystal used in the embodiment has an average particle diameter of 500 or more angstroms (preferably, 2000 or more angstroms) based on a measurement using the BET method.

Note that the preparation of the vapor-phase MgO single crystal is described in "Preparation of magnesia powder using a vapor phase method and its properties" (*Zairyou* (Materials) Vol. 36, No. 410, pp. 1157-1161, November 1987), and the like.

In the above-mentioned PDP, a reset discharge, an address discharge and a sustaining discharge for generating an image are produced in the discharge cell C.

When the reset discharge initiated prior to the address discharge is produced in the discharge cell C, the duration of the priming effects resulting from the reset discharge is increased because of presence of the crystalline MgO layer 5, thereby speeding up the address discharge process.

Further, the PDP uses, as a discharge gas filling the discharge space, a gas mixture containing 10 or more vol % of xenon giving a high xenon partial pressure. Because of this, the amount of emission of vacuum ultraviolet light from the discharge gas, which results from the sustaining discharge, is increased to make it possible to provide a high luminous efficiency.

Typically, the relationship between the concentration of the xenon included in the discharge gas and the breakdown voltage for each of the reset, address and sustaining discharges is a so-called "tradeoff", in which, as the concentration of the xenon in the discharge gas is increased, the voltage required to start each of the discharges is increased. A simple increase in the concentration of the xenon in the discharge gas results in a reduction in the discharge probability.

In the PDP of the embodiment, even if a gas mixture having a high partial pressure of xenon is used as the discharge gas as described above, the rise in the breakdown voltage for each discharge is moderated. This is because the crystalline MgO layer 5 is formed of MgO crystals including vapor-phase MgO single crystals as described above.

Specifically, FIG. 8 shows a graph of comparisons of the breakdown voltages for a discharge (reset discharge, sustain discharge) initiated between the row electrodes and the breakdown voltages for a discharge (address discharge) initiated between the column electrode and the row electrode in each of the discharge cells in which the red, green and blue phosphor layers are formed respectively, between the case when the vapor-phase MgO layer is not formed in the area facing the discharge space and the case when the vapor-phase MgO layer is formed in the area facing the discharge space.

The left half of FIG. 8 shows the case when the vapor-phase MgO layer is not formed, and the right half thereof shows the case when the vapor-phase MgO layer is formed, in which a1, a2 denote the breakdown voltage for a discharge between the row electrodes (reset discharge, sustain discharge); b1, b2 denote the break down voltage for a discharge between the column electrode and the row electrode in the discharge cell in which the red phosphor layer is formed (address discharge); c1, c2 denote the breakdown voltage for a discharge between the column electrode and the row electrode in the discharge cell in which the green phosphor layer is formed (address discharge); and d1, d2 denote a breakdown voltage for a discharge between the column electrode and the row electrode in the discharge cell in which the blue phosphor layer is formed (address discharge).

It is seen from the above graph that, when the vapor-phase MgO layer is formed in the area facing the discharge space of the PDP, the breakdown voltage between the row electrodes is reduced by about 7V and the breakdown voltage between the column electrode and the row electrode is reduced by about 10V to about 20V, as compared with those when the vapor-phase MgO layer is not formed in the area.

Accordingly, in the aforementioned PDP shown in FIGS. 1 to 3, even if a gas mixture including 10 or more vol % of xenon giving a high xenon partial pressure is used as the discharge gas, the rise in the breakdown voltage for each discharge is restrained because the crystalline MgO layer 5 is formed of MgO crystals including vapor-phase MgO single crystals.

Typically, when a PDP initiates the address discharge, an electrostatic force is generated by a voltage applied to the row electrode on the front glass substrate 1 and a voltage applied to the column electrode D on the back glass substrate 6, and produces resonance on the front glass substrate 1 and the back glass substrate 6, resulting in vibration. However, in the PDP of the embodiment, even when a gas mixture having a high xenon partial pressure is used as the discharge gas, because the crystalline MgO layer 5 formed of MgO crystals including the vapor-phase MgO single crystals inhibits a rise in the breakdown voltage for the address discharge, there is no possibility of an increase in physical energy being caused by the electrostatic force generated between the front glass substrate 1 and the back glass substrate 6. In consequence, audible noise produced by the vibration of the substrates is prevented.

Further, because the crystalline MgO layer 5 is formed of MgO crystals including the vapor-phase MgO single crystals, the PDP of the embodiment shortens the time of the discharge delay of the sustaining discharge to narrow the range of discharge variation. Hence, even when more than the predetermined number of discharge cells C out of the total discharge cells Care selected as the light-emitting cells having the deposition of a wall charge on the dielectric layer 3 to produce the sustaining discharge, the sustain discharges are concurrently initiated in the respective light-emitting cells, resulting in a further improvement in luminous efficiency.

FIG. 9 is a diagram illustrating the comparison between the discharge variation in a PDP having no vapor-phase MgO layer formed in the area facing the discharge space (the left graph in FIG. 9) and the variation in discharge delay in a PDP having the vapor-phase MgO layer formed (the right graph in FIG. 9).

In FIG. 9, in the PDP without the vapor-phase MgO layer, the range of the discharge variation is wide and the voltage drop in the sustain pulse applied to the row electrode pairs is small. However, in the PDP with the vapor-phase MgO layer, the range of the discharge variation is narrow and the discharges are simultaneously initiated. For this reason, in the latter PDP, the voltage drop in the sustain pulse at the time the discharge is initiated is large, resulting in an improvement in the luminous efficiency.

The following can be considered as the reason for the shortening of the time of the discharge delay in the above PDP with the crystalline MgO layer 5.

Figure 10:
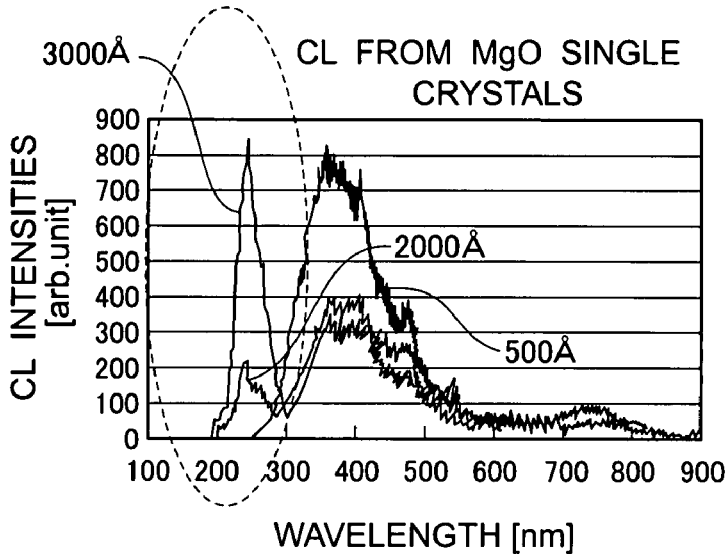
FIG. 10 is a graph showing the relationship between the particle sizes of magnesium oxide single crystals and the wavelength of a CL emission in the embodiment.
Figure 11:
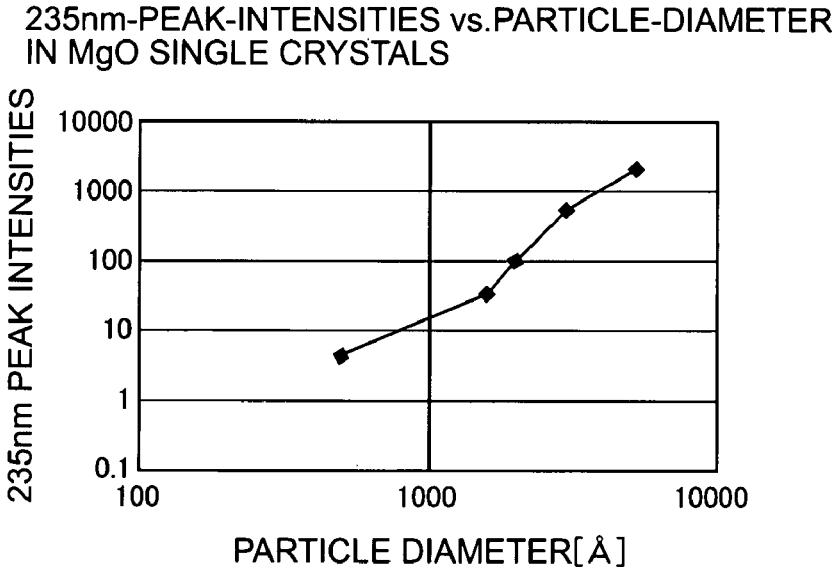
FIG. 11 is a graph showing the relationship between the particle sizes of magnesium oxide single crystals and the intensities of a CL emission at 235 nm in the embodiment.

Specifically, as shown in FIGS. 10 and 11, in the PDP with the crystalline MgO layer 5, the application of electron beam initiated by the discharge excites a CL emission having a peak within a wavelength range of 200 nm to 300 nm (particularly, of 230 nm to 250 nm, around 235 nm), in addition to a CL emission having a peak within a wavelength range of 300 nm to 400 nm, from the large-particle-diameter vapor-phase MgO single crystal included in the crystalline MgO layer 5.

Figure 12:
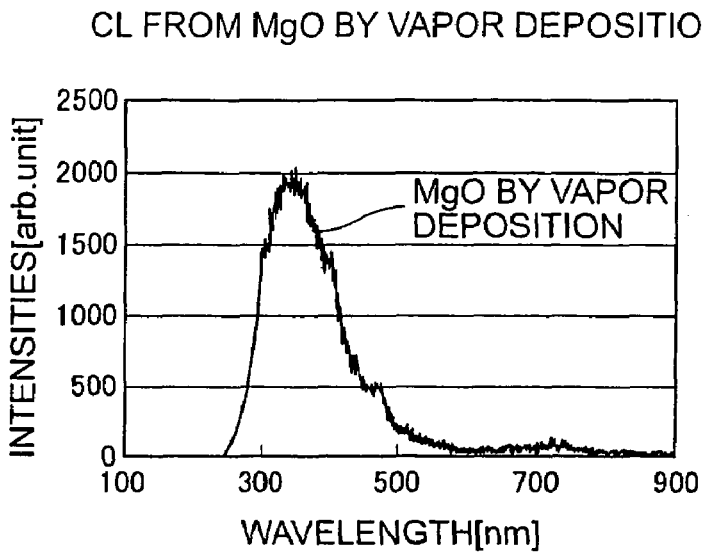
FIG. 12 is a graph showing the state of the wavelength of a CL emission from the magnesium oxide layer formed by vapor deposition.

As shown in FIG. 12, a CL emission with peak wavelengths around 235 nm is not excited from a MgO layer formed by use of usual vapor deposition (the thin film MgO layer 4 in the embodiment), but only a CL emission having a peak wavelengths from 300 nm to 400 nm is excited.

As seen from FIGS. 10 and 11, the greater the particle diameter of the vapor-phase MgO single crystal, the stronger the peak intensity of the CL emission having a peak within the wavelength range from 200 nm to 300 nm (particularly, of 230 nm to 250 nm, around 235 nm).

It is conjectured that the presence of the CL emission having the peak wavelength from 200 nm to 300 nm will bring about a further improvement of the discharge characteristics (a reduction in discharge delay, an increase in the discharge probability).

More specifically, the conjectured reason that the crystalline MgO layer 5 causes the improvement of the discharge characteristics is because the vapor-phase MgO single crystal causing the CL emission having a peak within the wavelength range from 200 nm to 300 nm (particularly, of 230 nm to 250 nm, around 235 nm) has an energy level corresponding to the peak wavelength, so that the energy level enables the trapping of electrons for long time (some msec. or more), and the trapped electrons are extracted by an electric field so as to serve as the primary electrons required for starting a discharge.

Also, because of the correlationship between the intensity of the CL emission and the particle size of the vapor-phase MgO single crystal, the stronger the intensity of the CL emission having a peak within the wavelength range from 200 nm to 300 nm (particularly, of 230 nm to 250 nm, around 235 nm), the greater the improvement of the discharge characteristics caused by the vapor-phase MgO single crystal.

In other words, for the preparation of vapor-phase MgO single crystals having a large particle size, an increase in the heating temperature is required when magnesium vapor is generated. Because of this, the length of flame with which magnesium and oxygen react increases, and therefore the temperature difference between the flame and the surrounding ambience increases. Thus, it is conceivable that the larger the particle size of the vapor-phase MgO single crystal, the greater the number of energy levels occurring in correspondence with the peak wavelengths (e.g. around 235 nm, a range from 230 nm to 250 nm) of the CL emission as described earlier.

In a further conjecture regarding the vapor-phase MgO single crystal of a cubic polycrystal structure, many plane defects occur, and the presence of energy levels arising from these plane defects contributes to an improvement in discharge probability.

The BET specific surface area (s) is measured by a nitrogen adsorption method. The particle diameter ($D_{BET}$) of the vapor-phase MgO single crystal forming the crystalline MgO layer 5 is calculated from the measured value by the following equation.

$$D_{BET}=A/s\times\rho,$$

where

A: shape count (A=6)

ρ: real density of magnesium.

Figure 13:
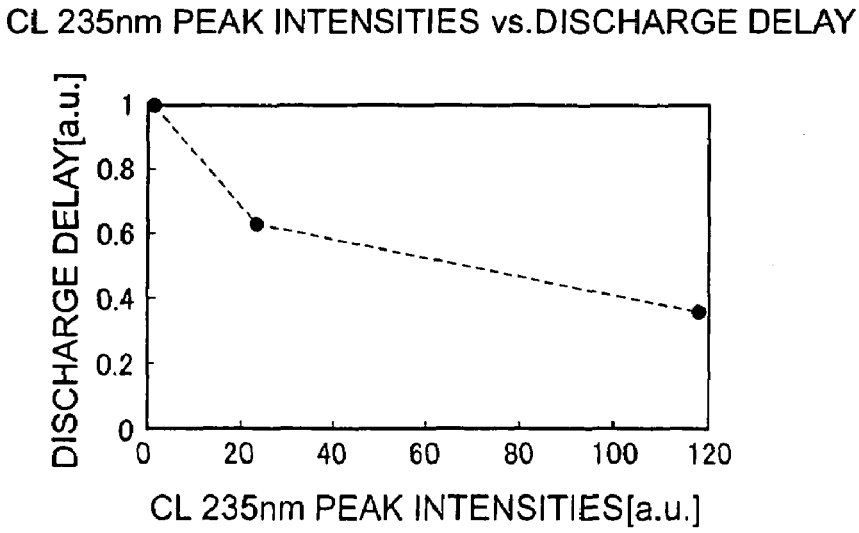
FIG. 13 is a graph showing the relationship between the discharge delay and the peak intensities of a CL emission at 235 nm from the magnesium oxide single crystal.

FIG. 13 is a graph showing the correlatioship between the CL emission intensities and the discharge delay.

It is seen from FIG. 13 that the discharge delay in the PDP is shortened by the 235 nm CL emission excited from the crystalline MgO layer 5, and further as the intensity of the 235 nm CL emission increases, the discharge delay time is shortened.

Figure 14:
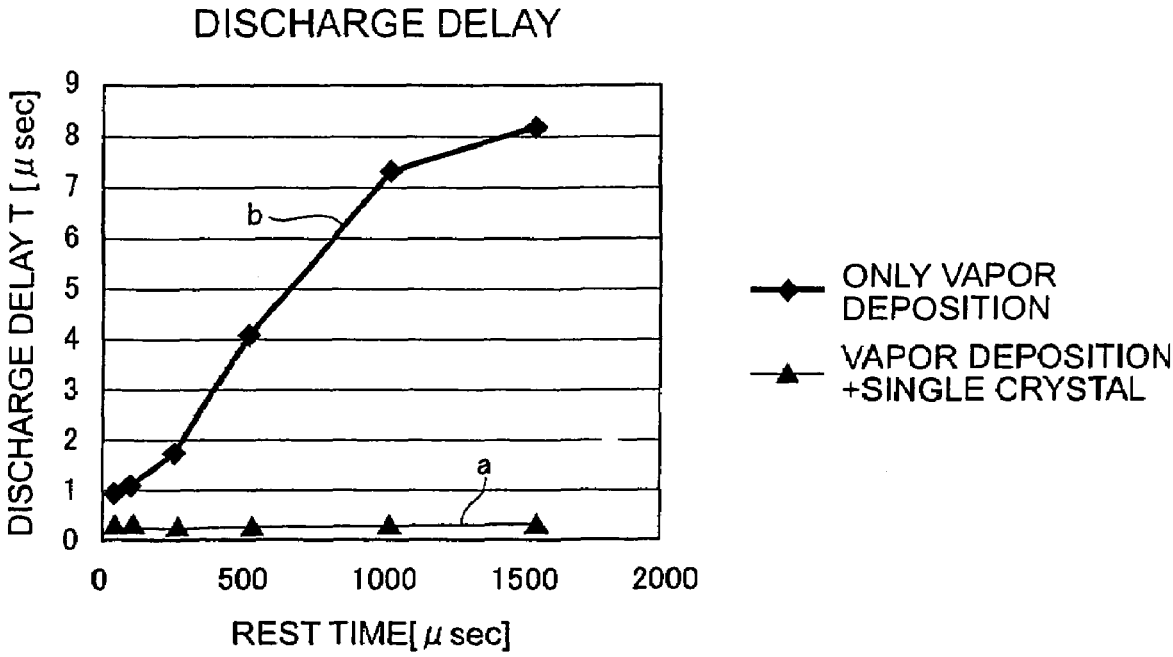
FIG. 14 is a graph showing the comparison of the discharge delay characteristics between the case when the protective layer is constituted only of a magnesium oxide layer formed by vapor deposition and that when the protective layer has a double layer structure made up of a crystalline magnesium layer and a thin film magnesium layer formed by vapor deposition.

FIG. 14 shows the comparison of the discharge delay characteristics between the case of the PDP having the double-layer structure of the thin-film MgO layer 4 and the crystalline MgO layer 5 as described earlier (Graph a), and the case of a conventional PDP having only a MgO layer formed by vapor deposition (Graph b).

As seen from FIG. 14, the double-layer structure of the thin-film MgO layer 4 and the crystalline MgO layer 5 of the PDP offers a significant improvement in the discharge delay characteristics of the PDP over that of a conventional PDP having only a thin-film MgO layer formed by vapor deposition.

As described hitherto, in addition to the conventional type of the thin-film MgO layer 4 formed by vapor deposition or the like, the crystalline MgO layer 5, which includes the MgO crystals causing a CL emission having a peak with in a wavelength range from 200 nm to 300 nm upon excitation by an electron beam, is formed and laminated. This design allows an improvement of the discharge characteristics such as those relating to the discharge delay. Thus, the PDP of the present invention is capable of showing satisfactory discharge characteristics.

The MgO single crystals used for forming the crystalline MgO layer 5 has an average particle diameter of 500 or more angstroms based on a measurement using the BET method, preferably, of a range from 2000 angstroms to 4000 angstroms.

As described earlier, the crystalline MgO layer 5 is not necessarily required to cover the entire face of the thin-film MgO layer 4. For example, by use of patterning techniques, the crystalline MgO layers 5 may be formed partially on a portion of the thin-film MgO layer 4 facing the opposing portions of the transparent electrodes Xa and Ya of the row electrodes or on a portion of the thin-film MgO layer 4 not facing the opposing portions of the transparent electrodes Xa and Ya.

When the crystalline MgO layer 5 is partially formed, the area ratio of the crystalline MgO layer 5 to the thin-film MgO layer 4 is set in a range from 0.1% to 85%, for example.

The foregoing has described the example when the present invention applies to a reflection type AC PDP having the front glass substrate on which row electrode pairs are formed and covered with a dielectric layer and the back glass substrate on which phosphor layers and column electrodes are formed. However, the present invention is applicable to various types of PDPs, such as a reflection-type AC PDP having row electrode pairs and column electrodes formed on the front glass substrate and covered with a dielectric layer, and having phosphor layers formed on the back glass substrate; a transmission-type AC PDP having phosphor layers formed on the front glass substrate, and row electrode pairs and column electrodes formed on the back glass substrate and covered with a dielectric layer; a three-electrode AC PDP having discharge cells formed in the discharge space in positions corresponding to the intersections between row electrode pairs and column electrodes; a two-electrode AC PDP having discharge cells formed in the discharge space in positions corresponding to the intersections between row electrodes and column electrodes.

Further, the foregoing has described the example when the crystalline MgO layer 5 is formed through affixation by use of a spraying technique, an electrostatic coating technique or the like. However, the crystalline MgO layer 5 may be formed through application of a coating of a paste including powder of MgO crystals by use of a screen printing technique, an offset printing technique, a dispenser technique, an inkjet technique, a roll-coating technique or the like. Alternatively, a coating of a paste including MgO crystals may be applied on a support film and then be dried to go into film form. Then, the resulting film may be laminated on the thin-film MgO layer.

Still further, the foregoing has described the example of the PDP in which the thin-film MgO layer and the crystalline MgO layer are formed. However, the present invention is applicable to a PDP in which the crystalline MgO layer alone is formed.

The terms and description used herein are set forth by way of illustration only and are not meant as limitations. Those skilled in the art will recognize that numerous variations are possible within the spirit and scope of the invention as defined in the following claims.

What is claimed is:

1. A plasma display panel, equipped with opposing front and back substrates placed on either side of a discharge space, a plurality of row electrode pairs provided between the front and back substrates, and a plurality of column electrodes provided between the front and back substrates and extending in a direction at right angles to the row electrode pairs to form unit light emission areas in the discharge space at positions respectively corresponding to the intersections with the row electrode pairs, comprising:

a discharge gas including 10 or more vol % of xenon and filling the discharge space; and a magnesium oxide layer including magnesium oxide crystals that have a crystalline structure causing a cathode-luminescence emission having a peak within a wavelength range of 200 nm to 300 nm upon excitation by an electron beam, and provided in a position facing the unit light emission areas, wherein the magnesium oxide layer has a structure of lamination of a thin-film magnesium oxide layer and a crystalline magnesium oxide layer including the magnesium oxide crystals.

2. A plasma display panel according to claim 1, wherein the magnesium oxide crystals are magnesium oxide single crystals produced by use of a vapor-phase oxidation technique.

3. A plasma display panel according to claim 1, wherein the magnesium oxide crystals have a crystalline structure causing a cathode-luminescence emission having a peak within a wavelength range from 230 nm to 250 nm.

4. A plasma display panel according to claim 1, wherein the magnesium oxide crystals include magnesium oxide crystals having a particle diameter of 2000 or more angstroms.

5. A plasma display panel according to claim 1, wherein the magnesium oxide layer is formed by spraying a powder of the magnesium oxide crystals on the thin-film magnesium oxide layer.

6. A plasma display panel according to claim 1, wherein the row electrode pairs and a dielectric layer covering the row electrode pairs are formed on the front substrate and the magnesium oxide layer is formed on the dielectric layer.

7. A plasma display panel according to claim 6, further comprising a partition wall unit provided between the front substrate and the back substrate for partitioning the discharge space into the unit light emission areas, wherein the column electrodes and a dielectric layer covering the column electrodes are formed on the back substrate, and a phosphor layer covering side faces of the partition wall unit and the dielectric layer covering the column electrodes is formed in each of the unit light emission areas.

8. The plasma display panel according to claim 1, wherein said magnesium oxide crystals comprise magnesium oxide single crystals.

9. The plasma display panel according to claim 1, wherein said magnesium oxide layer is formed over an entire surface of said thin-film magnesium oxide layer.

10. The plasma display panel according to claim 1, wherein said magnesium oxide layer is formed over an entire rear-facing surface of said thin-film magnesium oxide layer.

11. The plasma display panel according to claim 1, wherein said magnesium oxide layer is formed over less than an entire surface of said thin-film magnesium oxide layer.

* * * * *